US007363221B2

(12) United States Patent
Droppo et al.

(10) Patent No.: US 7,363,221 B2
(45) Date of Patent: Apr. 22, 2008

(54) METHOD OF NOISE REDUCTION USING INSTANTANEOUS SIGNAL-TO-NOISE RATIO AS THE PRINCIPAL QUANTITY FOR OPTIMAL ESTIMATION

(75) Inventors: James G. Droppo, Duvall, WA (US); Li Deng, Sammamish, WA (US); Alejandro Acero, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 889 days.

(21) Appl. No.: 10/643,370

(22) Filed: Aug. 19, 2003

(65) Prior Publication Data

US 2005/0043945 A1 Feb. 24, 2005

(51) Int. Cl.
*G10L 21/02* (2006.01)

(52) U.S. Cl. ..... 704/226; 704/233

(58) Field of Classification Search ..... None
See application file for complete search history.

(56) References Cited

U.S. PATENT DOCUMENTS

| | | | | |
|---|---|---|---|---|
| 4,897,878 | A * | 1/1990 | Boll et al. | 704/233 |
| 6,778,954 | B1 * | 8/2004 | Kim et al. | 704/226 |
| 2002/0002455 | A1 * | 1/2002 | Accardi et al. | 704/226 |

OTHER PUBLICATIONS

Ephraim et al., "Speech enhancement using a minimum-mean square error short-time spectral amplitude estimator", IEEE Transactions on Acoustics, Speech, and Signal Processing, vol. 32, Issue: 6, Dec. 1984, pp. 1109-1121.*

Ephraim et al., "Speech enhancement using a minimum mean-square error log-spectral amplitude estimator", IEEE Transactions on Acoustics, Speech, and Signal Processing, vol. 33, Issue: 2, Apr. 1985, pp. 443-445.*

Attais et al., "A New Method for Speech Denoising and Robust Speech Recognition Using Probabilistic Models for Clean Speech and for Noise", In Eurospeech-2001, 1903-1906.*

B. Frey, L. Deng, A. Acero, and T. Kristjansson, "Algonquin: Iterating Laplace's method to remove multiple types of acoustic distortion for robust speech recognition," in *Proc. 2001 Eurospeech,* Aalbork, Denmark, Sep. 2001.

J. Droppo, A. Acero, and L. Deng, "A nonlinear observation model for removing noise from corrupted speech log Mel-spectral energies," in *Proc. ICSLP,* Denver, CO, Sep. 2002, pp. 182-185.

(Continued)

*Primary Examiner*—David Hudspeth
*Assistant Examiner*—Brian L. Albertalli
(74) *Attorney, Agent, or Firm*—Theodore M. Magee; Westman, Champlin & Kelly, P.A.

(57) ABSTRACT

A system and method are provided that accurately estimate noise and that reduce noise in pattern recognition signals. The method and system define a mapping random variable as a function of at least a clean signal random variable and a noise random variable. A model parameter that describes at least one aspect of a distribution of values for the mapping random variable is then determined. Based on the model parameter, an estimate for the clean signal random variable is determined. Under many aspects of the present invention, the mapping random variable is a signal-to-noise ratio variable and the method and system estimate a value for the signal-to-noise ratio variable from the model parameter.

23 Claims, 5 Drawing Sheets

OTHER PUBLICATIONS

H.G. Hirsch and D. Pearce, "The Aurora experimental framework for the performance evaluations of speech recognition system under noisy conditions," in *ISCA ITRW ASR2000 "Automatic Speech Recognition?" Challenges for the Next Millennium,* Paris, France, Sep. 2000.

T. Kristjansson, B. Frey, and L. Deng, "Joint estimation of noise and channel distortion in a generalized EM framework," in *Proc. ASRU 2001,* Madonna di Campiglio, Italy, Dec. 2001.

The Official Search Report of the European Patent Office in counterpart foreign application No. 04103502.3 filed Jul. 22, 2004.

Li Deng et al., "A Bayesian Approach to Speech Feature Enhancement Using the Dynamic Cepstral Prior," 2002 IEEE International Conference on Acoustics, Speech and Signal Processing, May 2002.

Moreno et al., "Multivariate-Gaussian-Based Cepstral Normalization for Robust Speech Recognition," Acoustics, Speech, and Signal Processing, 1995.

A First Office Action from the People's Republic of China in counterpart foreign application No. 2004100642175 filed Aug. 19, 2004.

* cited by examiner

METHOD OF NOISE REDUCTION USING INSTANTANEOUS SIGNAL-TO-NOISE RATIO AS THE PRINCIPAL QUANTITY FOR OPTIMAL ESTIMATION

BACKGROUND OF THE INVENTION

The present invention relates to noise reduction. In particular, the present invention relates to removing noise from signals used in pattern recognition.

A pattern recognition system, such as a speech recognition system, takes an input signal and attempts to decode the signal to find a pattern represented by the signal. For example, in a speech recognition system, a speech signal (often referred to as a test signal) is received by the recognition system and is decoded to identify a string of words represented by the speech signal.

To decode the incoming test signal, most recognition systems utilize one or more models that describe the likelihood that a portion of the test signal represents a particular pattern. Examples of such models include Neural Nets, Dynamic Time Warping, segment models, and Hidden Markov Models.

Before a model can be used to decode an incoming signal, it must be trained. This is typically done by measuring input training signals generated from a known training pattern. For example, in speech recognition, a collection of speech signals is generated by speakers reading from a known text. These speech signals are then used to train the models.

In order for the models to work optimally, the signals used to train the model should be similar to the eventual test signals that are decoded. In particular, the training signals should have the same amount and type of noise as the test signals that are decoded.

Typically, the training signal is collected under "clean" conditions and is considered to be relatively noise free. To achieve this same low level of noise in the test signal, many prior art systems apply noise reduction techniques to the testing data.

In two known techniques for reducing noise in the test data, noisy speech is modeled as a linear combination of clean speech and noise in the time domain. Because the recognition decoder operates on Mel-frequency filter-bank features, which are in the log domain, this linear relationship in the time domain is approximated in the log domain as:

$$y=1n(e^x+e^n)+\epsilon \qquad \text{EQ. 1}$$

where y is the noisy speech, x is the clean speech, n is the noise, and $\epsilon$ is a residual. Ideally, $\epsilon$ would be zero if x and n are constant and have the same phase. However, even though $\epsilon$ may have an expected value of zero, in real data, $\epsilon$ has non-zero values. Thus, $\epsilon$ has a variance.

To account for this, one system under the prior art modeled $\epsilon$ as a Gaussian where the variance of the Gaussian is dependent on the values of the noise n and the clean speech x. Although this system provides good approximations for all regions of the true distribution, it is time consuming to train because it requires an inference in both x and n.

In another system, $\epsilon$ was modeled as a Gaussian that was not dependent on the noise n or the clean speech x. Because the variance was not dependent on x or n, its value would not change as x and n changed. As a result, if the variance was set too high, it would not provide a good model when the noise was much larger than the clean speech or when the clean speech was much larger than the noise. If the variance was set too low, it would not provide a good model when the noise and clean speech were nearly equal. To address this, the prior art used an iterative Taylor Series approximation to set the variance at an optimal level.

Although this system did not model the residual as being dependent on the noise or clean speech, it was still time consuming to use because it required an inference in both x and n.

SUMMARY OF THE INVENTION

A system and method are provided that reduce noise in pattern recognition signals. The method and system define a mapping random variable as a function of at least a clean signal random variable and a noise random variable. A model parameter that describes at least one aspect of a distribution of values for the mapping random variable is then determined. Based on the model parameter, an estimate for the clean signal random variable is determined. Under many aspects of the present invention, the mapping random variable is a signal-to-noise variable and the method and system estimate a value for the signal-to-noise variable from the model parameter.

DETAILED DESCRIPTION OF ILLUSTRATIVE EMBODIMENTS

Figure 1:
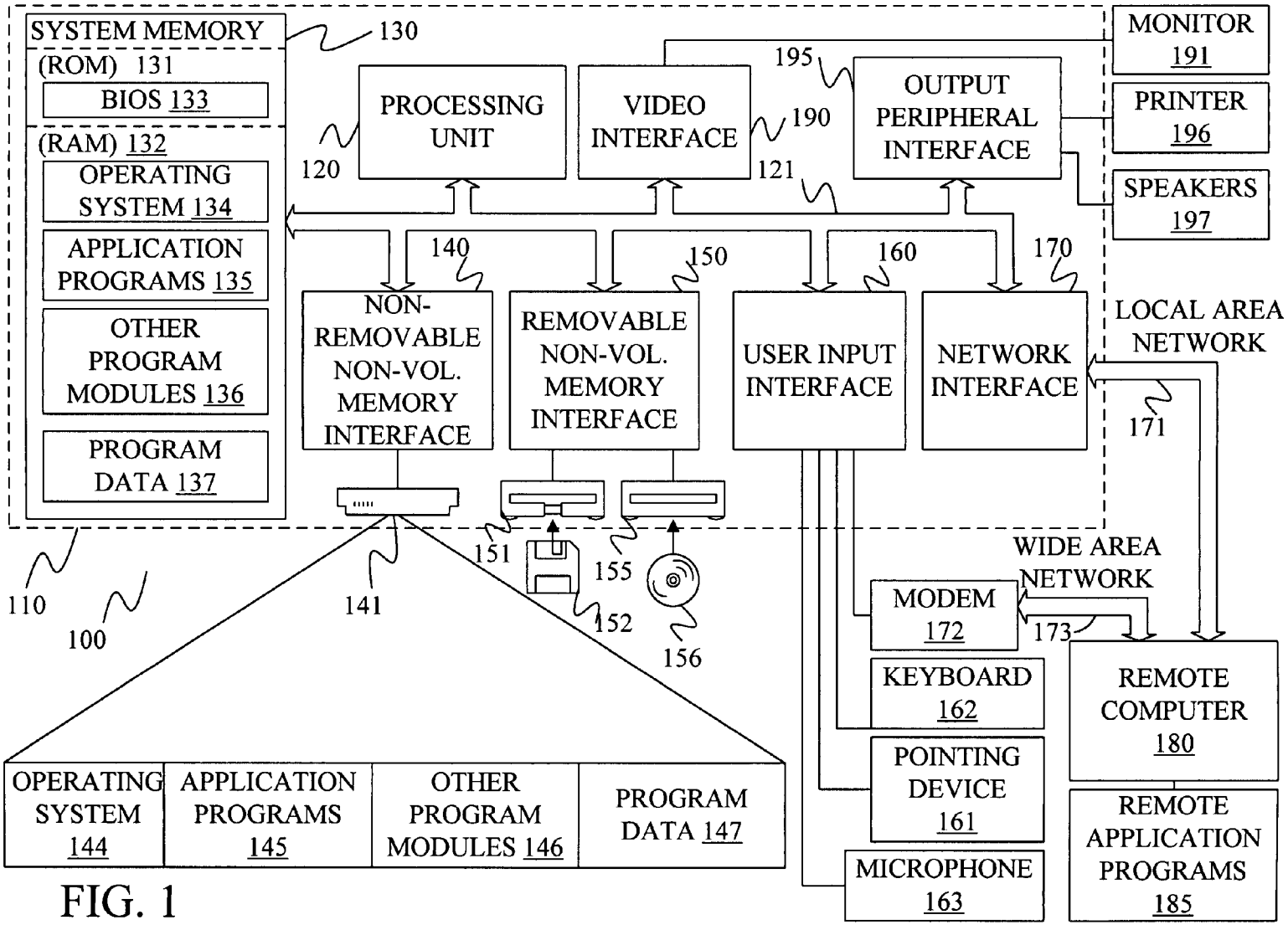
FIG. 1 is a block diagram of one computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention is designed to be practiced in distributed computing environments where tasks are performed by remote processing devices that are linked through a communications network. In a distributed computing environment, program modules are located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 is operated in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
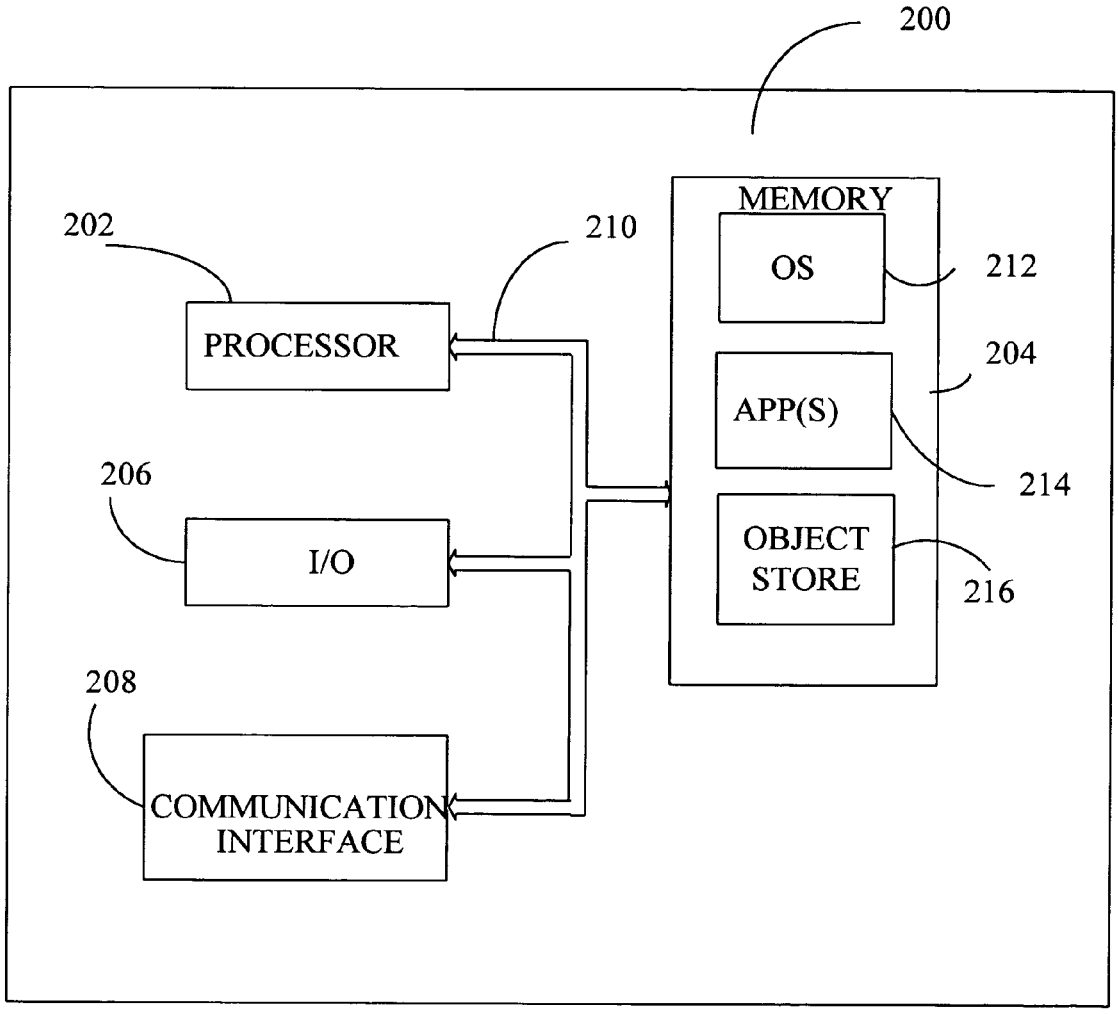
FIG. 2 is a block diagram of an alternative computing environment in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Under one aspect of the present invention, a system and method are provided that reduce noise in pattern recognition signals by assuming zero variance in the error term for the difference between noisy speech and the sum of clean speech and noise. In the past this has not been done because it was thought that it would not model the actual behavior well and because a value of zero for the variance made the calculation of clean speech unstable when the noise was much larger than the clean speech. This can be seen from:

$$x=1n(e^y-e^n) \quad \text{EQ. 2}$$

where x is a clean speech feature vector, y is a noisy speech feature vector and n is a noise feature vector. When n is much larger than x, n and y are nearly equal. When this occurs, x becomes sensitive to changes in n. In addition, constraints must be placed on n to prevent the term inside the logarithm from becoming negative.

To overcome these problems, the present invention utilizes the signal-to-noise ratio, r, which in the log domain of the feature vectors is represented as:

$$r=x-n \quad \text{EQ. 3}$$

Note that equation 3 provides one definition for a mapping random variable, r. Modifications to the relationship between x and n that would form different definitions for the mapping random variable are within the scope of the present invention.

Using this definition, equation 2 above can be rewritten to provide definitions of x and n in terms of the feature vector r as:

$$x=y-1n(e^r+1)+r \quad \text{EQ. 4}$$

$$n=y-1n(e^r+1) \quad \text{EQ. 5}$$

Note that in Equations 4 and 5 both x and n are random variables and are not fixed. Thus, the present invention assumes a value of zero for the residual without placing restrictions on the possible values for the noise n or the clean speech x.

Using these definitions for x and n, a joint probability distribution function can be defined as:

$$p(y,r,x,n,s)=p(y|x,n)p(r|x,n)p(x,s)p(n) \quad \text{EQ. 6}$$

where s is a speech state, such as a phoneme, p(y|x,n) is an observation probability that describes the probability of a noisy speech feature vector, y, given a clean speech feature vector, x, and a noise feature vector, n, p(r|x,n) is a signal-to-noise probability that describes the probability of a signal-to-noise ratio feature vector, r, given a clean speech feature vector and a noise feature vector, p(x,s) is a joint probability of a clean speech feature vector and a speech state, and p(n) is a prior probability of a noise feature vector.

The observation probability and the signal-to-noise ratio probability are both deterministic functions of x and n. As a result, the conditional probabilities can be represented by Dirac delta functions:

$$p(y|x,n)=\delta(1n(e^x+e^n)-y) \quad \text{EQ. 7}$$

$$p(r|x,n)=\delta(x-n-r) \quad \text{EQ. 8}$$

where $$\int_{-\varepsilon}^{\varepsilon}\delta(x)dx = 1, \text{ for all } \varepsilon > 0 \quad \text{EQ. 9}$$

$$\delta(x)=0, \text{for all } x\neq 0 \quad \text{EQ. 10}$$

This allows the joint probability density function to be marginalized over x and n to produce a joint probability p(y,r,s) as follows:

$$p(y,r,s)=\int dx \int dn\ p(y,r,x,n,s) \quad \text{EQ. 11}$$

$$p(y,r,s)=\int dx \int dn\ \delta(1n(e^x+e^n)-y)\delta(x-n-r)p(x,s)p(n) \quad \text{EQ. 12}$$

$$p(y,r,s)=p(x,s)|_{x=y-1n(e^r+1)+r}p(n)|_{n=y-1n(e^r+1)} \quad \text{EQ. 13}$$

$$p(y,r,s)=N(y-1n(e^r+1)+r;\mu_s^x,\sigma_s^x)p(s)$$

$$\cdot N(y-1n(e^r+1);\mu^n,\sigma^n) \quad \text{EQ. 14}$$

where p(x,s) is separated into a probability p(x|s) that is represented as a Gaussian with a mean $\mu_s^x$, and a variance $\sigma^x$ and a prior probability p(s) for the speech state and the probability p(n) is represented as a Gaussian with a mean $\mu^n$ and a variance $\sigma^n$.

To simplify the non-linear functions that are applied to the Gaussian distributions, one embodiment of the present invention utilizes a first order Taylor series approximation for a portion of the non-linear function such that:

$$1n(e^r+1)\approx f(r_s^o)+F(r_s^o)(r-r_s^o) \quad \text{EQ. 15}$$

where $$f(r_s^o)=1n(e^{r_s^o}+1) \quad \text{EQ. 16}$$

$$F(r_s^o)=diag\left(\frac{1}{1+e^{-r_s^o}}\right) \quad \text{EQ. 17}$$

where $r_s^0$ is an expansion point for the Taylor series expansion, $f(r_s^0)$ is a vector function such that the function is performed for each element in the signal-to-noise ratio expansion point vector $r_s^0$, and $F(r_s^0)$ is a matrix function that performs the function in the parentheses for each vector element of the signal-to-noise ratio expansion point vector and places those values along a diagonal of a matrix. For simplicity below, $f(r_s^0)$ is represented as $fr_s^0$ and $F(r_s^0)$ is represented as $F_s^0$.

The Taylor series approximation of equation 15 can then be substituted for $1n(e^r+1)$ in equation 14 to produce:

$$p(y,r,s)\approx N(y-f_s^o+F_s^o\cdot r_s^o-(F_s^o-I)r;\mu_s^x,\sigma_s^x)\cdot$$

$$N(y-f_s^o+F_s^o+r_s^o-F_s^o\cdot r;\mu^n,\sigma^n)p(s) \quad \text{EQ. 18}$$

Using standard Gaussian manipulation formulas, Equation 18 can be placed in a factorized form of:

$$p(y,r,s)=p(r|y,s)p(y|s)p(s) \quad \text{EQ. 19}$$

where $$p(r|y,s)=N(r;\hat{\mu}_s^r,\hat{\sigma}_s^r) \quad \text{EQ. 20}$$

$$\hat{\sigma}_s^r)^{-1}=(F_s^o-I)^T(\sigma_s^x)^{-1}(F_s^o-I)+F_s^{oT}(\sigma^n)^{-1}F_s^o \quad \text{EQ. 21}$$

$$\hat{\mu}_s^r=\hat{\sigma}_s^r(F_s^o-I)^T(\sigma_s^x)^{-1}(y-f_s^o+F_s^o\cdot r_s^o-\mu_s^x)$$

$$+\hat{\sigma}_s^rF_s^o(\sigma^n)^{-1}(y-f_s^o+F_s^o\cdot r_s^o-\mu^n) \quad \text{EQ. 22}$$

and $$p(y|s)=N(a_s;b_s,C_s) \quad \text{EQ. 23}$$

$$a_s=y-f_s^o+F_s^o\cdot r_s^o \quad \text{EQ. 24}$$

$$b_s=\mu^n+F_s^o(\mu_s^x-\mu^n) \quad \text{EQ. 25}$$

$$C_s=F_s^{oT}\sigma_s^xF_s^o+(F_s^o-I)^T\sigma^n(F_s^o-I) \quad \text{EQ. 26}$$

where $\hat{\mu}_s^r$ and $\hat{\sigma}_s^r$ are the mean and variance of the signal-to-noise ratio for speech state s.

Under one aspect of the present invention, equations 20-26 are used to determine an estimated value for clean speech and/or the signal-to-noise ratio. A method for making these determinations is shown in the flow diagram of FIG. 3, which is describe below with reference to the block diagram of FIG. 4.

Figure 3:
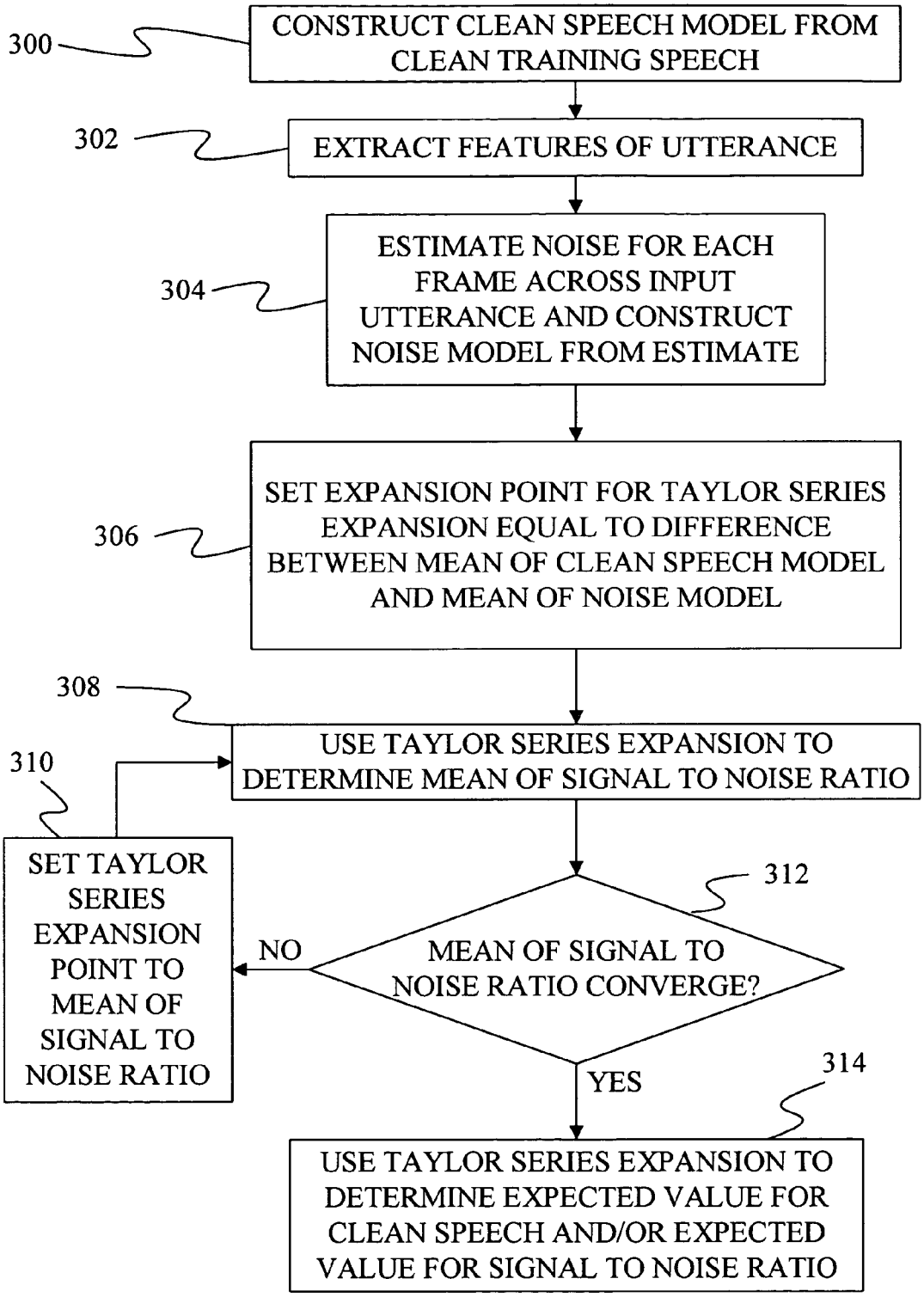
FIG. 3 is a flow diagram of a method of using a noise reduction system of one embodiment of the present invention.

In step 300 of FIG. 3, the means $\mu_s^x$ and variances $\sigma_s^x$ of a clean speech model, as well as the prior probability p(s) of each speech state s are trained from clean training speech and a training text. Note that a different mean and variance is trained for each speech state s. After they have been trained, the clean speech model parameters are stored in a noise reduction parameter storage unit 416.

At step 302, features are extracted from an input utterance. To do this, a microphone 404 of FIG. 4, converts audio waves from a speaker 400 and one or more additive noise sources 402 into electrical signals. The electrical signals are then sampled by an analog-to-digital converter 406 to generate a sequence of digital values, which are grouped into frames of values by a frame constructor 408. In one embodiment, A-to-D converter 406 samples the analog signal at 16 kHz and 16 bits per sample, thereby creating 32 kilobytes of speech data per second and frame constructor 408 creates a new frame every 10 milliseconds that includes 25 milliseconds worth of data.

Each frame of data provided by frame constructor 408 is converted into a feature vector by a feature extractor 410. Methods for identifying such feature vectors are well known in the art and include 39-dimensional Mel-Frequency Cepstrum Coefficients (MFCC) extraction. Under one particular embodiment, the log energy feature used in most MFCC extraction systems is replaced with $c_0$, and power spectral density is used instead spectral magnitude.

At step 304, the method of FIG. 3 estimates noise for each frame of the input signal using a noise estimation unit 412. Any known noise estimation technique may be used under the present invention. For example, the technique described in T. Kristjansson, et al., "Joint estimation of noise and channel distortion in a generalized EM framework," in Proc. ASRU 2001, Italy, December 2001, may be used. Alternatively, a simple speech/non-speech detector may be used.

The estimates of the noise across the entire utterance or a substantial portion of the utterance are used by a noise model trainer 414, which constructs a noise model that includes the mean $\mu^n$ and the variance $\sigma^n$ from the estimated noise. The noise model is stored in noise reduction parameter storage 416.

At step 306, a noise reduction unit 418 uses the mean of the clean speech model and the mean of the noise model to determine an initial expansion point $r_s^0$ for the Taylor series expansion of equations 21 and 22. In particular, the initial expansion point for each speech unit is set equal to the difference between the clean speech mean for the speech unit and the mean of the noise.

Once the Taylor series expansion point has been initialized, noise reduction unit 418 uses the Taylor series expansion in Equations 21 and 22 to calculate the means $\hat{\mu}_s^r$ of the signal-to-noise ratios for each speech unit at step 308. At step 310, the means of the signal-to-noise ratios are compared to previous values for the means (if any) to determine if the means have converged to stable values. If they have not converged (or this is the first iteration) the process continues at step 312 where the Taylor series expansion points are set to the respective means of the signal-to-noise ratios. The process then returns to step 308 to re-estimate the means of the signal-to-noise ratios using Equations 21 and 22. Steps 308, 310, and 312 are repeated until the means of the signal-to-noise ratios converge.

Once the means of the signal-to-noise ratios are stable, the process continues at step 314 where the Taylor series expansion is used to determine an estimate for the clean speech and/or an estimate for the signal-to-noise ratio. The estimate for the clean speech is calculated as:

$$\hat{x} = \sum_s E[x \mid y, s]p(s \mid y) \qquad \text{EQ. 27}$$

where $$E[x|y,s] \approx y - 1n(e^{\hat{\mu}_s^r}+1)+\hat{\mu}_s^r \qquad \text{EQ. 28}$$

$$p(s \mid y) = \frac{p(y \mid s)p(s)}{\sum_s p(y \mid s)p(s)} \qquad \text{EQ. 29}$$

and where p(y|s) is calculated using Equations 23-26 above and p(s) is taken from the clean speech model.

The estimated value for the signal-to-noise ratio is calculated as:

$$\hat{r} = \sum_s \hat{\mu}_s^r p(s \mid y) \qquad \text{EQ. 30}$$

Thus, the process of FIG. 3 can produce an estimated value 420 for the signal-to-noise ratio and/or an estimated value 422 for the clean speech feature vector for each frame of the input signal.

Figure 5:
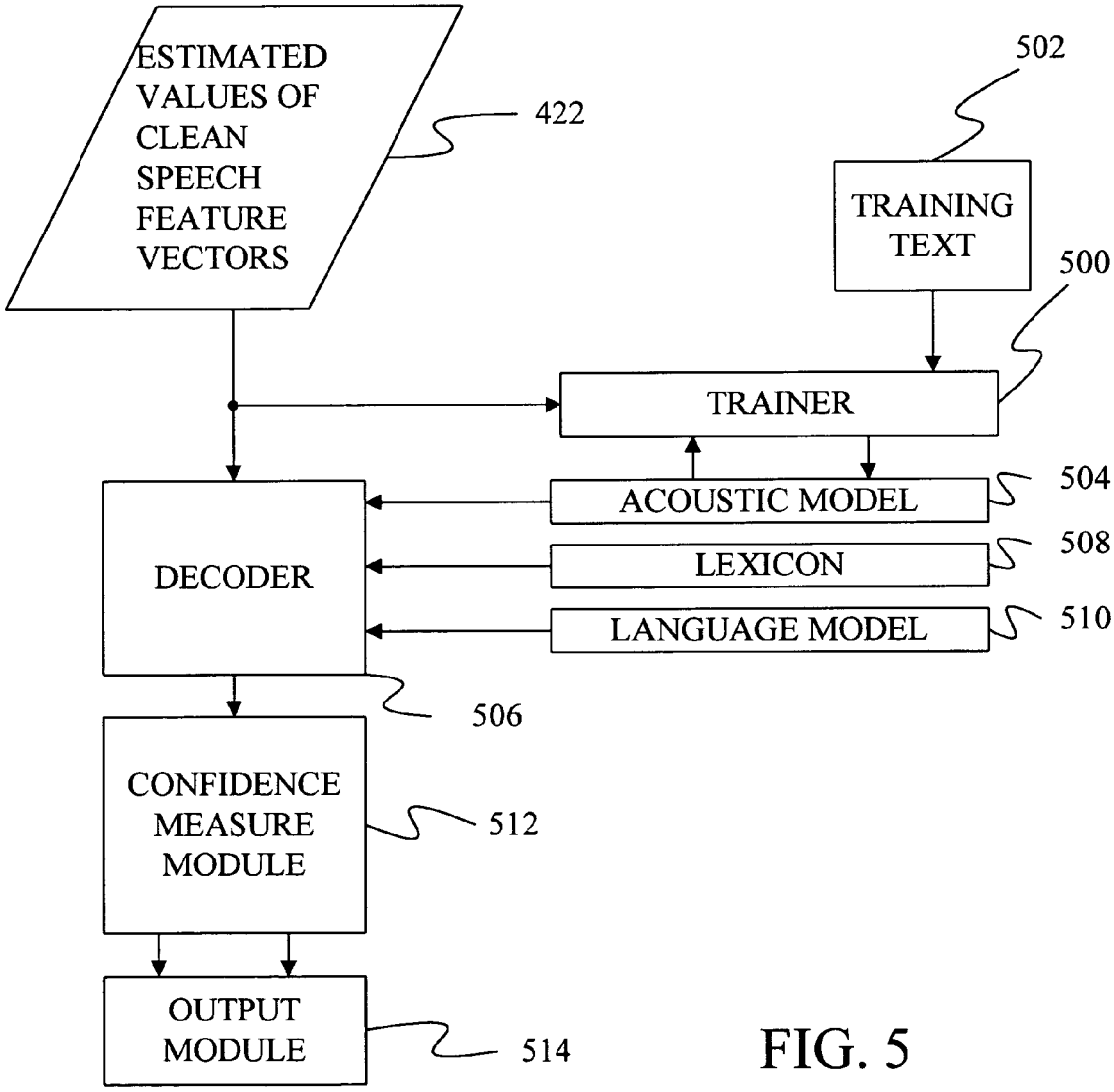
FIG. 5 is a block diagram of pattern recognition system with which embodiments of the present invention may be practiced.

The estimated values for the signal-to-noise ratios and the clean speech feature vectors can be used for any desired purposes. Under one embodiment, the estimated values for the clean speech feature vectors are used directly in a speech recognition system as shown in FIG. 5.

If the input signal is a training signal, the series of estimated values for the clean speech feature vectors 422 is provided to a trainer 500, which uses the estimated values for the clean speech feature vectors and a training text 502 to train an acoustic model 504. Techniques for training such models are known in the art and a description of them is not required for an understanding of the present invention.

If the input signal is a test signal, the estimated values of the clean speech feature vectors are provided to a decoder 506, which identifies a most likely sequence of words based on the stream of feature vectors, a lexicon 508, a language model 510, and the acoustic model 504. The particular method used for decoding is not important to the present invention and any of several known methods for decoding may be used.

The most probable sequence of hypothesis words is provided to a confidence measure module 512. Confidence measure module 512 identifies which words are most likely to have been improperly identified by the speech recognizer, based in part on a secondary acoustic model(not shown). Confidence measure module 512 then provides the sequence of hypothesis words to an output module 514 along with identifiers indicating which words may have been improperly identified. Those skilled in the art will recognize that confidence measure module 512 is not necessary for the practice of the present invention.

Figure 4:
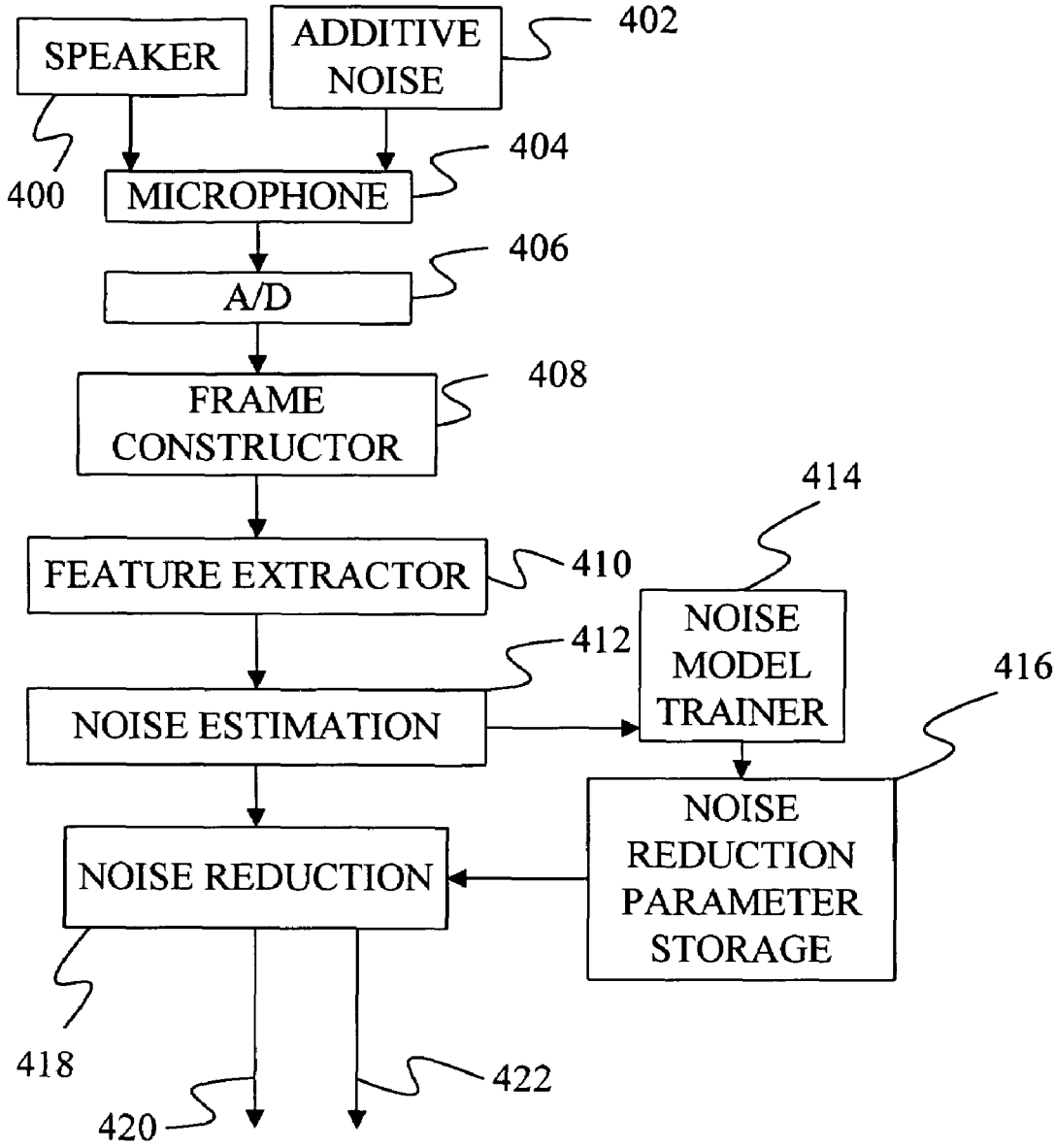
FIG. 4 is a block diagram of a noise reduction system and signal-to-noise recognition system in which embodiments of the present invention may be used.

Although FIGS. 4 and 5 depict speech systems, the present invention may be used in any pattern recognition system and is not limited to speech.

Although the present invention has been described with reference to particular embodiments, workers skilled in the art will recognize that changes may be made in form and detail without departing from the spirit and scope of the invention.

What is claimed is:

1. A method of identifying an estimate for a clean signal random variable representing a portion of a clean signal found within a noisy signal, the method comprising:

defining a mapping random variable as a function of at least the clean signal random variable and a noise random variable;

determining a model parameter that describes at least one aspect of a distribution of values for the mapping random variable, wherein determining a model parameter comprises approximating a function of the mapping random variable using a Taylor series expansion; and using the model parameter to determine an estimate for the clean signal random variable from an observed value.

2. The method of claim 1 wherein defining the mapping random variable as a function of at least the clean signal random variable and the noise random variable comprises defining the mapping variable as a ratio of the clean signal random variable to the noise random variable.

3. The method of claim 2 wherein determining a model parameter comprises determining a mean of the mapping random variable.

4. The method of claim 1 further comprising using the model parameter to determine an estimate of the mapping random variable.

5. The method of claim 4 wherein defining the mapping random variable as a function of at least the clean signal random variable and the noise random variable comprises defining the mapping variable as a ratio of the clean signal random variable to the noise random variable.

6. The method of claim 1 further comprising performing an iteration comprising steps of:

calculating a mean for the mapping random variable using a Taylor series expansion;

setting a new expansion point for the Taylor series expansion equal to the mean of the mapping random variable; and repeating the iteration steps using the new expansion point.

7. The method of claim 1 further comprising;

determining a clean signal model parameter that describes at least one aspect of a distribution of values for the clean signal random variable; and using the clean signal model parameter to determine the estimate for the clean signal random variable.

8. The method of claim 7 further comprising:

determining a noise model parameter that describes at least one aspect of a distribution of values for the noise random variable; and using the noise model parameter to determine the estimate for the clean signal random variable.

9. The method of claim 8 wherein determining the noise model parameter comprises determining the noise model parameter from noise estimates collected from the noisy signal.

10. A computer-readable storage medium storing computer-executable instructions for performing steps comprising:

defining a random variable as a function of a signal-to-noise ratio variable;

determining a mean for a distribution of the signal-to-noise ratio variable based on the defined function; and using the mean to determine an estimate of a value for the signal-to-noise ratio variable for a frame of an observed signal.

11. The computer-readable storage medium of claim 10 wherein the random variable comprises a clean signal random variable representing a portion of a clean signal.

12. The computer-readable storage medium of claim 10 wherein the random variable comprises a noise signal random variable representing a noise in an observed signal.

13. The computer-readable storage medium of claim 10 wherein defining a random variable further comprises defining the random variable as a function of an observed value.

14. The computer-readable storage medium of claim 10 wherein determining a mean further comprises approximating at least a portion of the defined function with an approximation function.

15. The computer-readable storage medium of claim 14 wherein the approximation function comprises a Taylor series approximation.

16. The computer-readable storage medium of claim 15 wherein determining a mean further comprises performing an iteration.

17. The computer-readable storage medium of claim 16 wherein performing an iteration comprises performing steps of:

using the Taylor series approximation to determine a mean for the signal-to-noise ratio;

setting a new expansion point equal to the mean for the signal-to-noise ratio; and repeating the step of using the Taylor series approximation to determine a mean while using the new expansion point.

18. The computer-readable storage medium of claim 10 further comprising using the mean to determine an estimate of the random variable.

19. The computer-readable storage medium of claim 18 wherein the random variable is a clean signal random variable representing a portion of a clean signal.

20. The computer-readable storage medium of claim 10 wherein determining a mean further comprises determining the mean based on a model parameter that describes a distribution of clean signal values, each clean signal value representing a portion of a clean signal.

21. The computer-readable storage medium of claim 10 wherein determining a mean further comprises determining the mean based on a model parameter that describes a distribution of noise values.

22. The computer-readable storage medium of claim 21 further comprising determining the mean from an observed signal.

23. A computer-readable storage medium storing computer-executable instructions for performing steps comprising:

defining a random variable as a function of a signal-to-noise ratio variable;

determining distribution parameters for the signal-to-noise ratio based on the defined function wherein determining a distribution parameter comprises approximating at least a portion of the defined function with a Taylor Series approximation; and using the distribution parameters to determine an estimate of the signal-to-noise ratio.

* * * * *

UNITED STATES PATENT AND TRADEMARK OFFICE

CERTIFICATE OF CORRECTION

PATENT NO. : 7,363,221 B2
APPLICATION NO. : 10/643370
DATED : April 22, 2008
INVENTOR(S) : James G. Droppo et al.

It is certified that error appears in the above-identified patent and that said Letters Patent is hereby corrected as shown below:

In column 10, line 52, in Claim 7, delete "comprising;" and insert -- comprising: --, therefor.

Signed and Sealed this
Fifteenth Day of February, 2011

David J. Kappos

David J. Kappos
*Director of the United States Patent and Trademark Office*